United States Patent [19]

Wallenfang et al.

[11] Patent Number: 4,619,239

[45] Date of Patent: Oct. 28, 1986

[54] FUEL INJECTION ARRANGEMENT FOR INTERNAL COMBUSTION ENGINES

[75] Inventors: Gerd Wallenfang; Reda Rizk, both of Cologne; Hans-Gottfried Michels, Erftstadt, all of Fed. Rep. of Germany

[73] Assignee: Klöckner-Humboldt-Deutz Aktiengesellschaft, Cologne, Fed. Rep. of Germany

[21] Appl. No.: 573,803

[22] Filed: Jan. 25, 1984

[30] Foreign Application Priority Data

Jan. 25, 1983 [DE] Fed. Rep. of Germany ..... 3302294

[51] Int. Cl.[4] ..... F02M 39/00

[52] U.S. Cl. ..... 123/506; 123/458; 251/129.10

[58] Field of Search ..... 123/506, 458, 500, 501; 251/137, 141

[56] References Cited

U.S. PATENT DOCUMENTS

| | | | |
|---|---|---|---|
| 2,947,258 | 8/1960 | Bessiere | 123/506 |
| 3,779,225 | 12/1973 | Watson | 123/506 |
| 3,851,635 | 12/1974 | Murtin | 123/458 |
| 4,310,143 | 1/1982 | Peterman | 251/137 |
| 4,336,896 | 6/1982 | Lunau | 251/137 |
| 4,361,309 | 11/1982 | Sogabe | 251/137 |
| 4,378,766 | 4/1983 | Yamzoe | 251/137 |
| 4,395,987 | 8/1983 | Kobayashi | 123/506 |
| 4,445,484 | 5/1984 | Marion | 123/506 |

FOREIGN PATENT DOCUMENTS

| | | | |
|---|---|---|---|
| 936838 | 11/1955 | Fed. Rep. of Germany | 251/137 |
| 2540388 | 11/1976 | Fed. Rep. of Germany | 251/137 |
| 0128428 | 8/1983 | Japan | 123/506 |

*Primary Examiner*—Carl Stuart Miller

*Attorney, Agent, or Firm*—Becker & Becker, Inc.

[57] ABSTRACT

A fuel injection arrangement for air-compressing, spontaneous-ignition, internal combustion engines. The arrangement includes at least one electromagnetic control valve via which a high-pressure channel of a fuel injection pump can be connected with a low-pressure channel. The control valve includes a valve body which is in the form of a piston valve, is spring-loaded, and is axially movable in a housing chamber which is provided with at least one connection on the high-pressure end, and with a connection on the low-pressure end. The piston valve is in operative connection with an electromagnetic adjusting device which can preferably be controlled by an electrically-operating data processor. The piston valve region on the high-pressure end is delimited by a valve seat and has a fixed diameter which corresponds to the diameter of the valve seat. The piston valve region on the low-pressure end has a diameter which is less than that of the piston valve region on the high-pressure end. The housing chamber taken in its entirety is sealed off in such a way as to be resistant to high pressure. The chambers on the low and high pressure ends can be connected by at least one line. The inventive fuel injection arrangement is characterized by an extremely stable behavior of the control valve and an absolute sealing in the closure position of the piston valve, so that the fuel injection arrangement itself is operational at the highest injection pressures.

24 Claims, 5 Drawing Figures

FUEL INJECTION ARRANGEMENT FOR INTERNAL COMBUSTION ENGINES

BACKGROUND OF THE INVENTION

1. Field of the Invention

The present invention relates to a fuel injection arrangement for an air-compressing, spontaneous-ignition, internal combustion engine. The arrangement is provided with at least one electromagnetic control valve via which a high-pressure channel of a fuel injection pump, that is provided with an intake line, can be connected with a low-pressure channel, preferably a discharge channel. The control valve comprises a valve body which is in the form of a piston valve, is spring loaded, and is axially movable in a chamber that is provided with at least one high-pressure connection and one low-pressure connection. The piston valve is operatively connected with an electromagnetic adjusting device which can preferably be controlled by an electrically-operating data processor.

A further, preferably mechanically operated, adjustment member may also be provided.

2. Description of the Prior Art

A fuel injection arrangement of the aforementioned general type is known from German Offenlegungsschrift 20 26 665. With this heretofore known arrangement, an electromagnetic control valve, which is controlled by the electrically-operating data processor as a function of characteristic operating parameters of the internal combustion engine, controls a discharge channel provided on the nozzle side in order in particular to regulate the beginning and end of injection of the fuel injection arrangement with regard to the load state of the internal combustion engine. The piston valve of the electromagnetic control valve has the same cross sectional area over its entire length j end faces of the piston valve are acted upon by pump pressure via pressure equalization lines in order in particular to keep low the required magnetic valve actuation adjustment force at the control valve. A drawback to this heretofore known fuel injection arrangement is that the piston valve of the control valve executes uncontrollable movements in the closure position, and hence exhibits an unstable behavior, which can be attributed in particular to a nonuniform pressure application upon the end faces of the piston valve, for example due to varying pressure waves, or to a more or less considerable formation of cavities in the pressure equalization lines. A further drawback is that a more or less considerable formation of cavities in the high-pressure system during control of the nozzle side and further conveyance on the pump side also result in instability with regard to regulation of the injection times.

Also known (German Offenlegungsschrift 29 03 482) is a fuel injection arrangement for an air-compressing, spontaneous-ignition, internal combustion engine according to which an electromagnetically actuated control valve is provided within the injection pump housing for controlling the injection times. On the one hand, this control valve controls the intake line of the injection pump, and on the other hand it connects a discharge channel with a high-pressure channel of the injection pump. The control valve is provided with a valve body which is in the form of a piston valve and is provided with a valve seat. A high-pressure chamber and a low-pressure chamber are provided in the piston valve on both sides of the valve seat. The opposing pressure attack surfaces of the high and low pressure chambers have the same surface area, so that from an ideal static standpoint, the piston valve is pressure balanced in the closure position. However, in addition to the considerable structural expense and the fact that further negative effects, for example caused by a fuel pump, can act via the intake line on the piston valve of the electromagnetic control valve, this heretofore known fuel injection arrangement has the drawback that the pressure forces which act upon the piston valve are only equalized in the closure position, since, during the opening phase of the piston valve, a resulting closure force is generated by a one-sided pressure drop due to the fuel discharging via the valve seat cross sectional area, so that heretoo a precise regulation of the injection process is not possible due to the unstable behavior of the piston valve.

In order to eliminate in particular the aforementioned drawbacks of the unstable behavior of the piston valve of German Offenlegungsschrift 29 03 482 in the opening phase, it was proposed (German Offenlegungsschrift 30 02 361) to give the pressure attack surfaces of the high-pressure chamber of the piston valve different dimensions, and to provide a stationary flow control device in the discharge channel. This solution is also not satisfactory, since, on the one hand, the throttled discharge stands in the way of a rapid pressure reduction at the end of injection in the sense of a favorable consumption and emission characteristic of the internal combustion engine, and, on the other hand, a constant throttling cannot take into account different operating levels of the internal combustion engine due to the respectively different control quantities.

It is therefore an object of the present invention to substantially improve a fuel injection arrangement of the aforementioned general type in such a way that precise control of the injection times is possible.

BRIEF DESCRIPTION OF THE DRAWINGS

This object, and other objects and advantages of the present invention, will appear more clearly from the following specification in conjunction with the accompanying drawings, in which.

SUMMARY OF THE INVENTION

Figure 1:
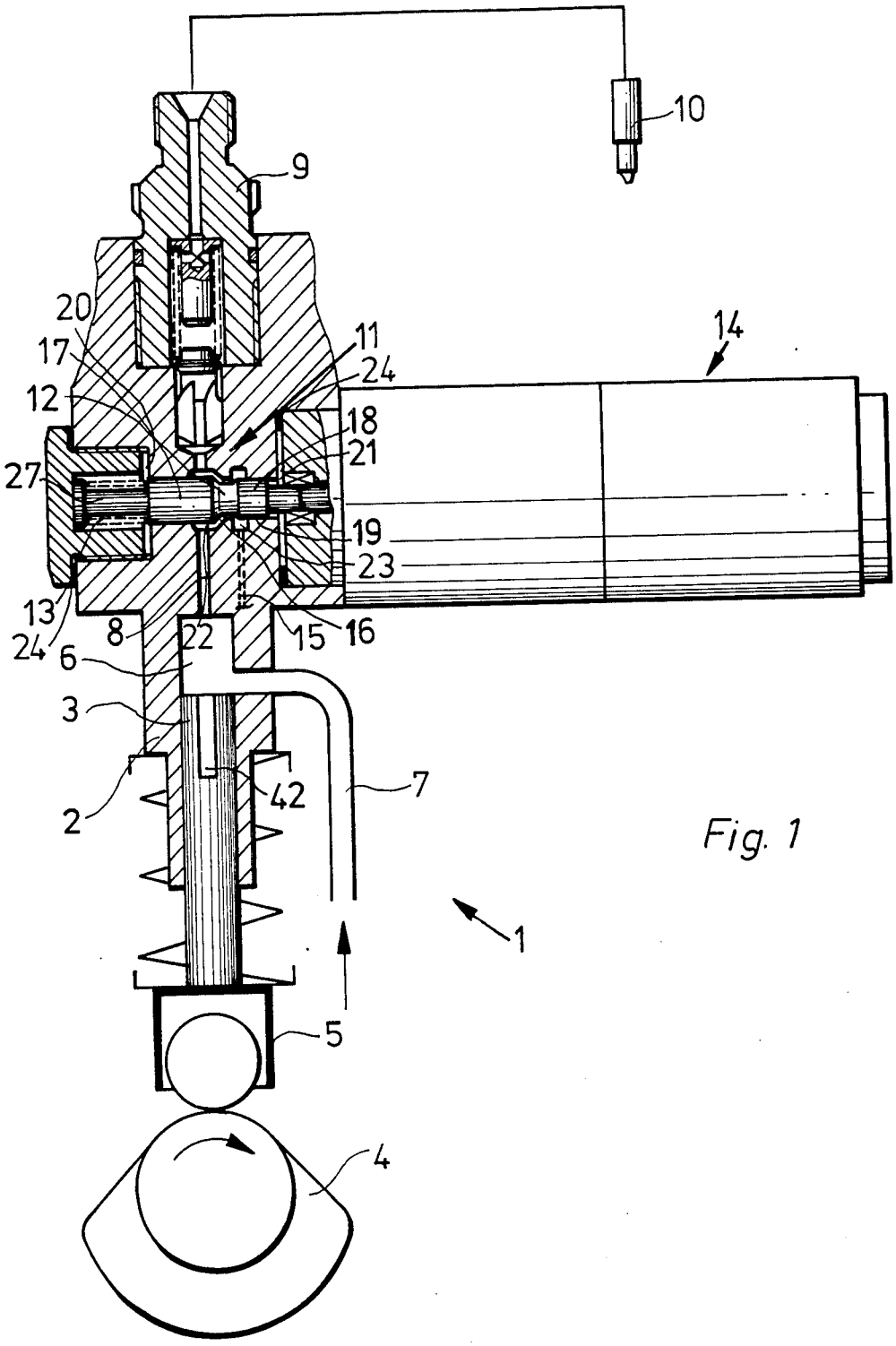
FIG. 1 is a schematic cross sectional view of one embodiment of the inventive fuel injection arrangement.

The fuel injection arrangement of the present invention is characterized primarily in that the piston valve region on the high-pressure end is delimited by a valve seat and has a fixed diameter which corresponds to the diameter of the valve seat, and in that the piston valve region on the low-pressure end has a diameter which is less than that of the piston valve region on the high-pressure end. With a valve body, i.e. piston valve, embodied in this way, surprisingly outstanding results can be achieved with regard to the operating results of the fuel injection arrangement. This in particular can be attributed to the fact that, on the one hand, nonuniform pressure distributions on the piston valve can no longer exert negative effects either in the closure position or in the opening phase of the control valve because the pressure attack surfaces have been eliminated on the piston valve region on the high-pressure end, so that an absolutely stable behavior of the piston valve is assured in all operating range, and, on the other hand, basically a resulting pressure force in the closure direction is present due to the large piston valve end face on the high-pressure end in the high-pressure phase. The inventive fuel injection arrangement also includes the further advantage of absolute sealing of the control valve in the high-pressure phase, which is critical for the operating results, especially with the very high injection pressures of 1000 to 2000 bar desired for air-compressing, spontaneous-ignition, internal combustion engines.

The housing chamber of the control valve preferably is sealed in a pressure resistant manner beyond the connections on the high and low pressure ends, and includes respective chambers on both the high and low pressure ends which are associated with the end faces of the piston valve. These chambers on the high and low pressure sides are interconnected by at least one line, which is preferably established by a bore provided within the piston valve. As a result of these embodiments of the present invention, all additional pressure equalization lines can be advantageously eliminated while maintaining a pressure equalization, and hence the advantage of lower adjustment forces at the end faces of the piston valve, so that possible pressure nonuniformities or pressure differences in pressure equalization lines cannot cause any negative effects on the control valve. Again, this can be of critical significance with the desired, very high injection pressures, and a correspondingly very short duration of injection, for the realization of the control times, which are determined by the electrically-operating data processor, for the beginning and end of injection of the fuel injection arrangement. Furthermore, these embodiments of the inventive fuel injection arrangement advantageously enhance the resulting closure pressure force which acts in the closure position of the piston valve. This can be attributed in particular to the fact that, in the closure position of the piston valve, the chamber on the high-pressure end is filled with fuel via the gap which exists between the chamber and the piston valve region on the high-pressure end, and the chamber on the low-pressure end is filled with fuel via the connecting line. During the opening movement of the piston valve, the fuel of the chamber on the high-pressure end is displaced into the chamber on the low-pressure end, so that due to the differently dimensioned piston valve regions, fuel is compressed on the low-pressure end by the stroke movement, which fuel flows off through the sealing gap on the low-pressure end. In the high-pressure phase, i.e. the closure position of the piston valve, thus fuel which has flowed off on the low-pressure end is again replenished via the high-pressure channel and the sealing gap on the high-pressure end, whereby a pressure drop occurs during the replenishing process in the direction of the chamber on the low-pressure end. This pressure drop produces the additional closure pressure force on the piston valve.

Further advantageous embodiments of the present invention, especially for realizing a rapid actuation of the valve body, which is advantageous for a precise control of the injection process, while optimizing the overall space requirement of the electromagnetic adjusting device, are as follows. For example, the piston valve region on the low-pressure side may be provided with a chamber which begins at the valve seat and cooperates with that connection of the housing chamber on the low-pressure end. The communication with the piston valve on the spring side and on the adjusting device side may be such that the end face region of the piston valve, which is subjected to chamber pressure on the high-pressure end, is greater than the end face region of the piston valve which is subjected to chamber pressure on the low-pressure end. The spring may be provided at that end face region of the piston valve on the high-pressure end, and may act on the piston valve for closing the same.

The electromagnetic adjusting device may be provided at that end face region of the piston valve on the low-pressure end, and may act upon the piston valve for opening the same. The electromagnetic adjusting device may be designed in such a way that it actuates the piston valve for opening the same after a pre-stroke travel of the adjusting device. The electromagnetic adjusting device may be provided with a first switching coil and a second switching coil, each of which is provided with an iron core and an armature. The piston valve may be actuated by the first switching coil in the opening direction, and may be held thereby in the open position. A spring element, which can be prestressed by energization of the first switching coil, can be mounted on the armature of the latter. A spacer may be provided on the armature of the first switching coil for delimiting the prestress travel of the spring element. For actuating the valve in the opening direction during operation of the electromagnetic adjusting device, the first switching coil can be deenergized.

The armature of the second switching coil may be embodied in two pieces and may comprise an inner armature part and an outer armature part, with the inner armature part being axially movable relative to the outer armature part. The inner and outer armature parts of the second switching coil may be adapted to be coupled for an axial movement. The piston valve can be actuated in the closing direction by deenergizing the second switching coil. The first and second switching coils, along with the associated armatures and iron cores, may be associated with the housing chamber on the low-pressure end, with the inner armature part of the second switching coil being in direct operative connection with the piston valve, and the armature of the first switching coil being in direct operative connection with the inner armature part of the second switching coil. A stop element may be provided between the first and the second switching coils, or the associated armatures thereof; this stop element delimits the axial stroke movement of the outer armature part of the second switching coil. The stop element, and the spacer of the armature of the first switching coil, are designed in such a way that between the inner armature part of the second switching coil in the closure position of the piston valve, and the armature of the first switching coil, a pre-stroke spacing exists when the spring element is at its maximum prestress. A spacer which delimits the axial movement of the outer armature part may be provided between the iron core and the outer armature part of the second switching coil. A stop may be associated with the end face of the piston valve region on the high-pressure end.

The first switching coil, along with the associated iron core and armature, may be associated with the housing chamber on the low-pressure end, and the second switching coil, along with the associated armature parts and the iron core, may be associated with the housing chamber on the high-pressure end. The armature of the first switching coil may be in direct operative connection with the piston valve, and the inner armature part of the second switching coil may be fastened to the piston valve. The iron core of the second switching coil may be provided with a shoulder which is in the form of a spacer and is associated with the inner armature part. The spacer of the first switching coil may be designed in such a way that in the closure position of the piston valve, the armature of the first switching coil can be axially spaced from the piston valve.

The fuel injection pump is provided with a pump element which may be rotatable about an axis of rotation that extends in the longitudinal direction of the pump element; the pump element may also be provided with a longitudinal groove which is preferably provided in the surface of the pump element and can communicate with a pump chamber. The pump element, for rotation thereof, can be actuated by a mechanical regulating device which is affected by the speed of the internal combustion engine. The longitudinal groove of the pump element can be made to overlap the intake line.

A sensor may be provided in the movement region of one of the end faces of the piston valve or of one of the armatures. This sensor comprises a permanent magnet, pull pieces, and an induction coil, and, as a function of the piston valve movement or of an air gap at one of the end faces of the piston valve, generates a pulse-like signal of the control valve for the beginning of closure and/or opening.

The control valve may be provided in or on a holding element which can be connected to the fuel injection pump; the control valve is adapted to be held on the piston valve via a holding force which is applied in the longitudinal direction of the latter. The holding element is provided with a stepped bore for receiving the control valve, which can be connected with the holding element via a screw connection. The holding element can be provided with a connecting piece which is disposed on the pump side and has a recess portion for receiving one or more pressure elements; the holding element can be connected with the fuel injection pump by means of a fastening member which can be threaded into a connection bore of the fuel injection pump and is in operative connection with the pressure elements. The holding element may also be provided with a receiving space for a pressure valve.

DESCRIPTION OF PREFERRED EMBODIMENTS

Referring now to the drawings in detail, basically identical parts are identified with the same reference numerals. FIG. 1 is a cross sectional illustration of one embodiment of the inventive fuel injection arrangement. This arrangement is provided in the customary manner with a fuel injection pump 1, which comprises a pump housing 2, a pump element 3 that is in the form of a pump piston and is driven in a known manner via a cam 4 and a spring-loaded push rod 5 and is movable within a pump chamber 6, an intake line 7, and a high-pressure channel 8. The fuel is fed via the intake line 7 and the pump chamber 6 to the fuel injection pump 1 from a non-illustrated fuel pump. During the stroke of the pump piston 3, the fuel is conveyed through the high-pressure channel 8 and via a pressure valve 9, which is embodied in a known manner, to a fuel injection nozzle 10.

The high-pressure channel 8 is controlled by an electromagnetic control valve 11, which comprises a valve body which is in the form of a piston valve 12 and is spring loaded by a compression spring 13. For opening the valve body, the latter is operatively connected with an electromagnetic adjusting device 14. Via the electromagnetic control valve 11, and in the open position thereof, the high-pressure channel 8 can communicate with a discharge channel 15, which leads, for example, to a fuel tank, so that in the high-pressure phase of the fuel injection pump 1, the beginning and end of injection of the fuel injection nozzle 10 can be regulated by opening and closing the electromagnetic control valve 11. To actuate the control valve, the electromagnetic adjusting device 14 is controlled by a non-illustrated electrically-operating data processor which interacts with suitable pick-up devices, and as a function of the load condition of the air-compressing, spontaneous ignition, internal combustion engine which is equipped with the inventive fuel injection arrangement, regulates the control time points and hence the beginning and end of injection. The piston valve 12 of the electromagnetic control valve 11 comprises a piston valve region 17 on the high-pressure end which is delimited by a valve seat 16, and a piston valve region 18 on the low-pressure end. The piston valve region 17 on the high-pressure end has a fixed diameter which corresponds to the diameter of the valve seat 16, and the piston valve region 18 on the low-pressure end has a diameter which is less than that of the region 17. The piston valve 12 is axially movable within a chamber 19 which is provided with a chamber 20 on the high-pressure end, and a chamber 21 on the low-pressure end. These chambers 20 and 21 are respectively associated with the end faces of the piston valve 12. The chambers 19, 20, and 21, beyond the connections 22 on the high-pressure end, and the connection 23 on the low-pressure end, are sealed in a pressure-resistant manner by suitable sealing elements 24. The chamber 20 on the high-pressure end, and the chamber 21 on the low-pressure end, are connected with one another via a bore 25 which is not visible in FIG. 1. The opening movement of the piston valve 12 is delimited by a spacer 27 which, like the spring 13, is disposed in the chamber 20 on the high-pressure end. With a view toward generating a resulting pressure closing force, the spacer 27, the compression spring 13, and the electromagnetic adjusting device 14 are provided on the end faces of the piston valve 12 in such a way, or the end faces of the piston valve 12 are designed in such a way, that that end face region of the piston valve 12 which is exposed to chamber pressure on the high-pressure end is greater than that end face region of the piston valve 12 which is exposed to chamber pressure on the low-pressure end.

The surface of the pump piston 3 is provided with a longitudinal groove 42 which is in flow communication with the pump chamber 6, and which, by rotating the pump piston 3, can overlap the intake line 7. To turn the pump piston 3, a non-illustrated mechanical control device is provided which operates as a function of the speed with commonly known means, such as centrifugal weights, etc. The control device, at a predeterminable maximum speed of the internal combustion engine, opens the connection of the pump chamber 6 to the intake line 7 for the purpose of controlling the fuel. This measure serves for an additional safety device.

Figure 2:
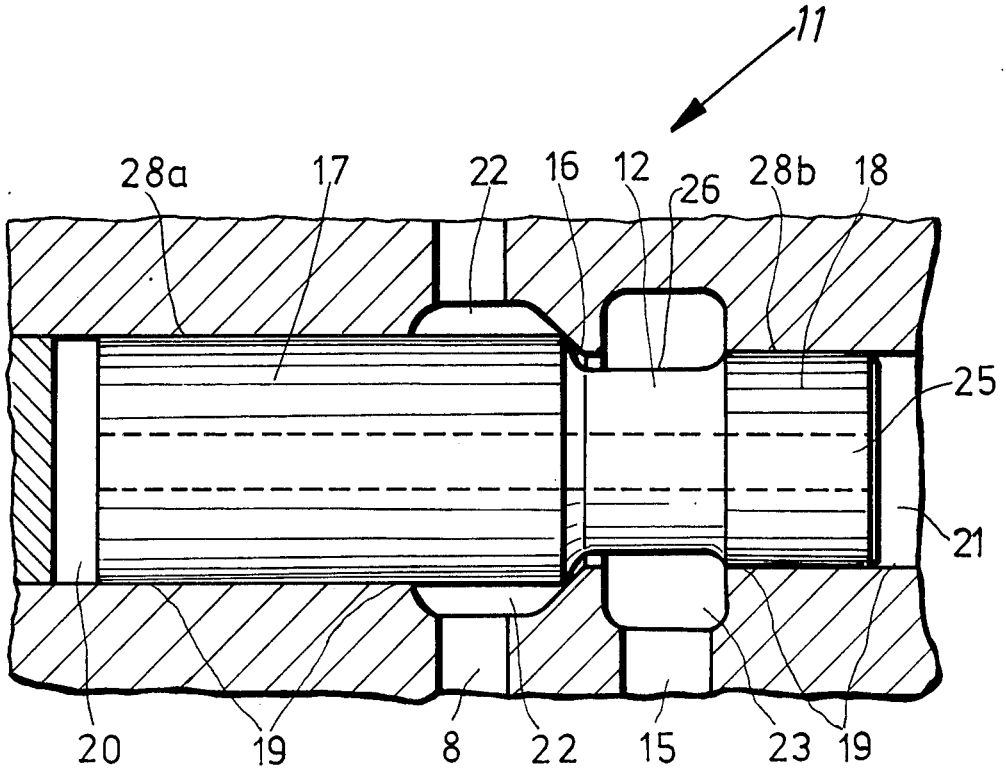
FIG. 2 is a schematic cross sectional view of an inventive control valve.

The operation and advantages of the inventively embodied control valve will be described in greater detail with the aid of the schematic illustration of FIG. 2. To facilitate illustration, the valve actuation elements, such as the compression spring, the electromagnetic adjusting device connection, and the like, are dispensed with in FIG. 2. Due to the piston valve design on the high-pressure end, i.e. the smooth transition into the valve seat 16, all pressure-attack surfaces for the very high fuel pressure are absent, so that possible unstable, nonuniform pressure distribution can exert no affect on the piston valve 12 in the closure position, which is critical for the regulatable injection process. During the high-pressure phase of the fuel injection pump 1, fuel is conveyed via the high-pressure channel 8 and the connections 22 of the control valve 11 on the high-pressure end to the fuel injection nozzle 10. Via the sealing gap 28*a* in the piston valve region 17 on the high-pressure end to the chamber 20 on the high-pressure end, and hence via the bore 25 also to the chamber 21 on the low-pressure end, there is a pressure drop which constantly assures that the chamber system is filled with fuel. As a result of the opening movement of the piston valve 12, fuel is displaced out of the chamber 20 on the high-pressure end into the chamber 21 on the low-pressure end. Due to the difference in diameters of the end faces of the piston valve 12, the fuel compresses in the chambers. In the opening position of the piston valve 12, this over pressure is reduced by fuel flowing off via the sealing gap 28*b* on the low-pressure end. In the closure position of the piston valve 12, this quantity of fuel which has flowed off is again replenished via the sealing gap 28*a* on the high-pressure end due to the pressure drop, whereby the filling process during the high-pressure phase exerts a further resulting pressure closure force on the piston valve 12; this pressure closure force enhances the sealing of the control valve 11, so that the latter is optimized in an advantageous manner in the closure position with regard to an absolute sealing.

Figure 3:
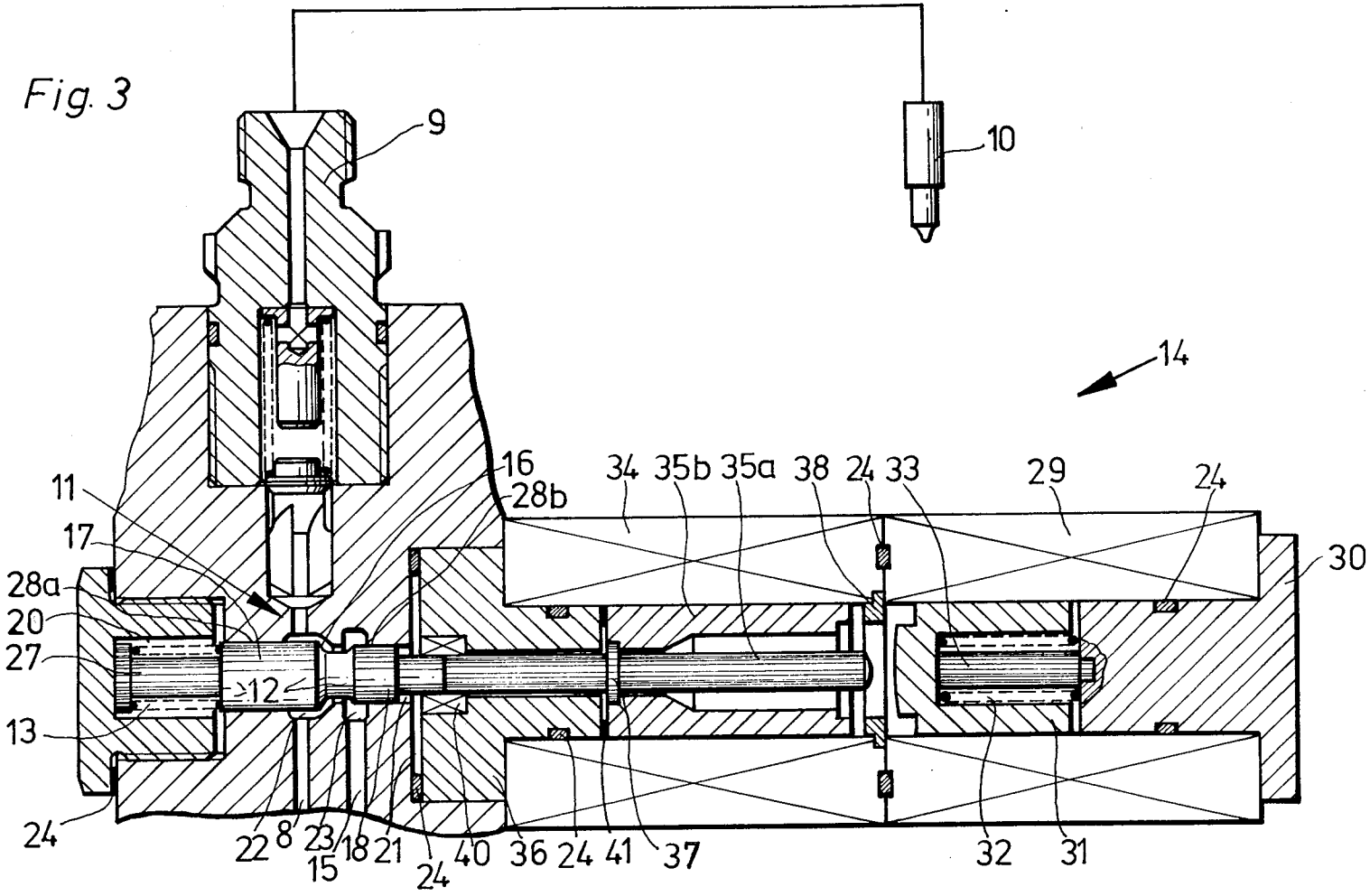
FIG. 3 is a cross sectional view of one embodiment of the inventive fuel injection arrangement which is provided with an inventively embodied electromagnetic adjusting device.

In FIG. 3, the inventive fuel injection arrangement of FIG. 1 is shown with an inventively embodied electromagnetic adjusting device 14. However, the illustrations of the known parts of the fuel injection pump are omitted. The inventive electromagnetic adjusting device 14 illustrated in the embodiment of FIG. 3 is designed in such a way that the piston valve 12, for opening same, can be actuated by a prestroke of the adjusting device, in order in particular in this way to utilize the generated impact effect for very rapid opening times and hence precise control of the piston valve 12. For this purpose, the electrical adjusting device 14 is provided with a first switching coil 29 having an iron core 30 and an armature 31. Fastened to the armature 31 is a spring element 32 which can be prestressed by the energization of the first switching coil 29 and by the movement of the armature 31; this prestressing of the spring element 32 is delimited by a spacer 33. The electromagnetic adjusting device is furthermore provided with a second switching coil 34 having a two-piece armature, and an iron core 36. The two-piece armature comprises an inner armature part 35*a* and an outer armature part 35*b*. The inner armature part 35*a* is axially movable relative to the outer armature part 35*b*, and can be fixedly coupled with the latter via a shoulder/collar connection 37. In this embodiment pursuant to FIG. 3, the first switching coil 29, with the associated armature 31 and the iron core 30, and the second switching coil 34, with the associated armature parts 35*a* and 35*b* and the second iron core 36, are associated with the chamber 21 on the low-pressure end and are provided with appropriate sealing elements 24. The inner armature part 35*a* of the second switching coil 34 acts directly upon the piston valve 12, and the armature 31 of the first switching coil 29 is in direct operative connection with the inner armature part 35*a* of the second switching coil 34. Between the first switching coil 29 and the second switching coil 34 there is provided a stop element 38 which delimits the axial stroke movement of the outer armature part 35*b* of the second switching coil 34 in one direction. The stop element 38 and the spacer 33 are designed in such a way that a prestroke space exists between the inner armature part 35*a* of the second switching coil 34 and the armature 31 of the first switching coil 29 in the closure position of the piston valve 12 at maximum prestress of the spring element 32. The axial stroke movement of the outer armature part 35*b* is delimited toward the other end relative to the iron core 36 by a non-magnetic spacer 41.

During operation of the inventive fuel injection arrangement, the switching coils 29 and 34 are controlled as a function of the control times of the electromagnetic control valve 11, said control times being determined by the electrically operating adjusting device. In this connection, the first switching coil 29 is energized during the closure position of the piston valve 12, and the second switching coil 34 is deenergized, so that the spring element 32 is at its maximum prestress; the outer armature part 35*b* rests against the stop element 38, and a pre-stroke space exists between the inner armature part 35*a* and the armature 31. When the opening signal, i.e. end of injection, of the electrically-operating adjusting device is generated, the first switching coil 29 is deenergized, so that via the spring element 32 initially only the armature 31, and hence advantageously only a very small mass, is accelerated, and abruptly opens the piston valve 12 by the pre-stroke travel, via the inner armature part 35*a*, as far as the spacer or stop 27. Due to the possibility for the inner armature part 35*a* to move axially relative to the outer armature part 35*b*, the latter initially remains at rest. After the opening movement of the piston valve 12, the second switching coil 34 is energized, so that the outer armature part 35*b* is brought to engagement against the spacer 41. Reenergizing the coil 29 again prestresses the spring element 32 and again brings the armature 31 into the pre-stroke position. The second switching coil 34 now takes over the function of holding the piston valve 12 against the force of the compression spring 13, whereby the stroke of the piston valve is no longer delimited by the stop 27, but rather by the engagement of the inner armature part 35*a* against the outer armature part 35*b* via the shoulder/collar connection 37.

The closure movement of the piston valve 12 is initiated by deenergizing the second switching coil 34, so that the compression spring 13 brings the piston valve 12 into the closure position. Advantageously, only the armature parts 35*a* and 35*b* need to be carried along in this connection.

When the inventive embodiment of the electromagnetic adjusting device 14, it is possible in an advantageous manner to keep the magnetic adjustment forces which are to be applied, and hence the overall volume required, low due to the prevailing holding function of the first and second switching coils 29 and 34.

A sensor 40 is provided in the movement region of that end face of the piston valve 12 on the low-pressure end. The sensor 40, which is not shown in greater detail, is provided with a permanent magnet, pole pieces, and an induction coil. The sensor 40 generates a pulse-like signal as a function of the movement of the piston valve or as a function of an air gap between the end face of the piston valve and the inner armature part 35*a*. This pulse-like signal can be utilized in the data processor as a closing or opening time point signal of the control valve, and can be appropriately taken into account during the control of the switching coils 29 and 34 for avoiding magnetic transmission errors. It should be noted that the illustrated disposition of the sensor 40 is not mandatory; rather, it is also inventively conceivable to dispose the sensor 40, or a second sensor, between the armature 31 and the outer and inner armature parts 35*a* and 35*b*.

Figure 4:
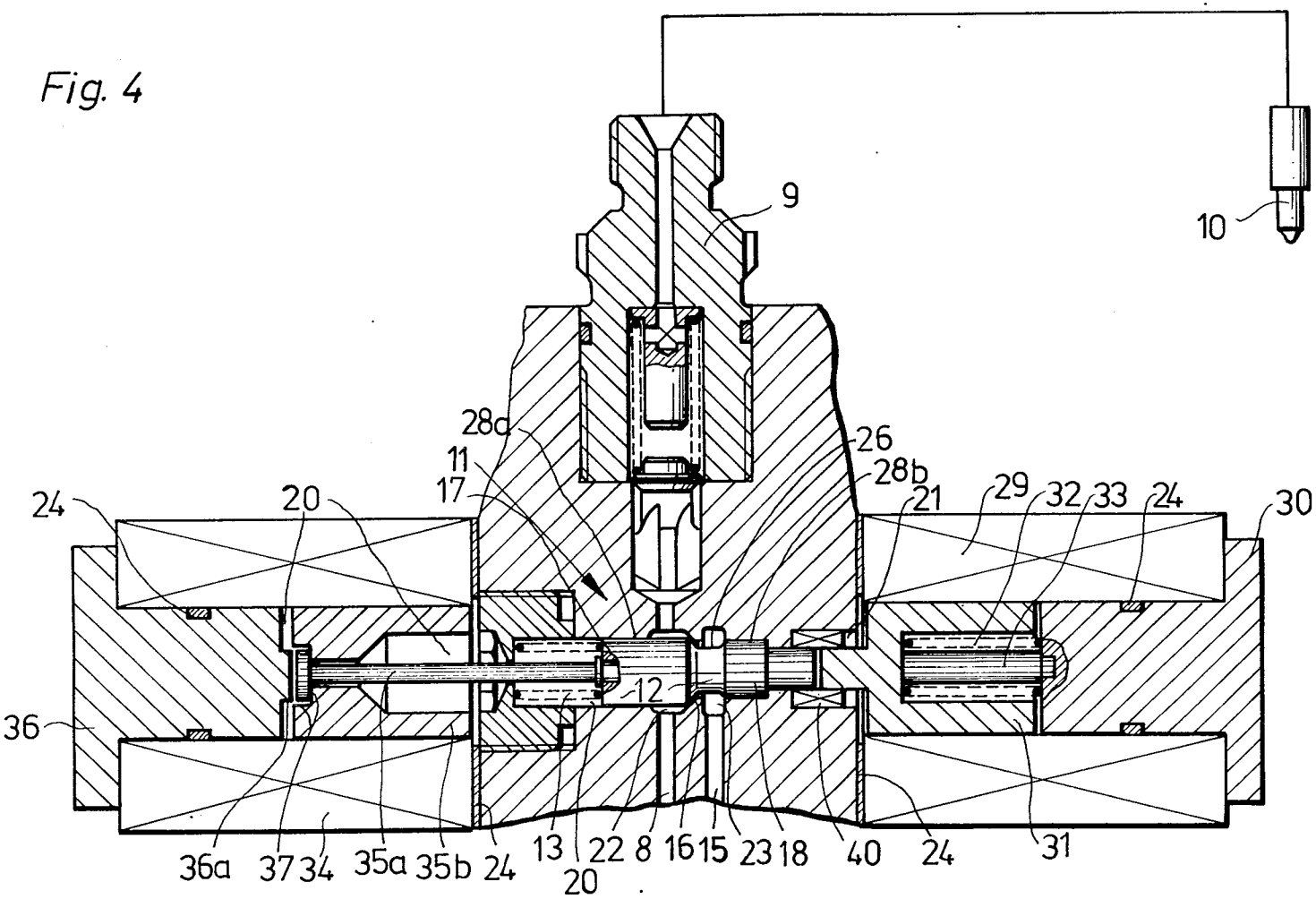
FIG. 4 is a cross sectional view of an inventive fuel injection arrangement having an alternatively embodied inventive electromagnetic adjusting device.

The embodiment of FIG. 4 resembles that of FIG. 3. However, the first switching coil 29, the iron core 30, and the armature 31 are associated with the chamber 21 on the low-pressure end. The second switching coil 34, the inner and outer armature parts 35*a* and 35*b*, and the iron core 36 are associated with the chamber 20 on the high-pressure end. Again, suitable sealing elements 24 are provided for sealing the chambers 20 and 21 in a pressure-tight manner. With this embodiment, the armature 31 of the first switching coil 29 is in direct operative connection with the piston valve 12, and the inner armature part 35*a* is fastened directly to the piston valve. To actuate the piston valve 12 for opening the same by a pre-stroke travel of the electromagnetic adjusting device 14, the spacer 33 is designed in such a way in this embodiment that in the closure position of the piston valve 12, the armature 31 can be axially spaced from the piston valve 12 by energizing the first switching coil 29. The iron core 36 is provided with a shoulder 36*a* which is in the form of a spacer and cooperates with the inner armature part 35*a*.

The time point of energization, or the duration of energization, of the first and second switching coils 29 and 34, as determined by the electrically-operating data processor, is effected in the manner similar to that described in connection with the embodiment of FIG. 3. In other words, the switching coil 29 can be deenergized for opening the valve, as a result of which the injection process is terminated during the high-pressure phase of the fuel injection pump 1, thus determining the end of injection. The closure of the valve is initiated by deenergizing the second switching coil 34, whereby the piston valve 12 is moved into the closure position under the force of the compression spring 13, thus determining the beginning of injection of the fuel injection arrangement. The advantages indicated in connection with the embodiment of FIG. 3 are similarly applicable to the embodiment of FIG. 4.

Figure 5:
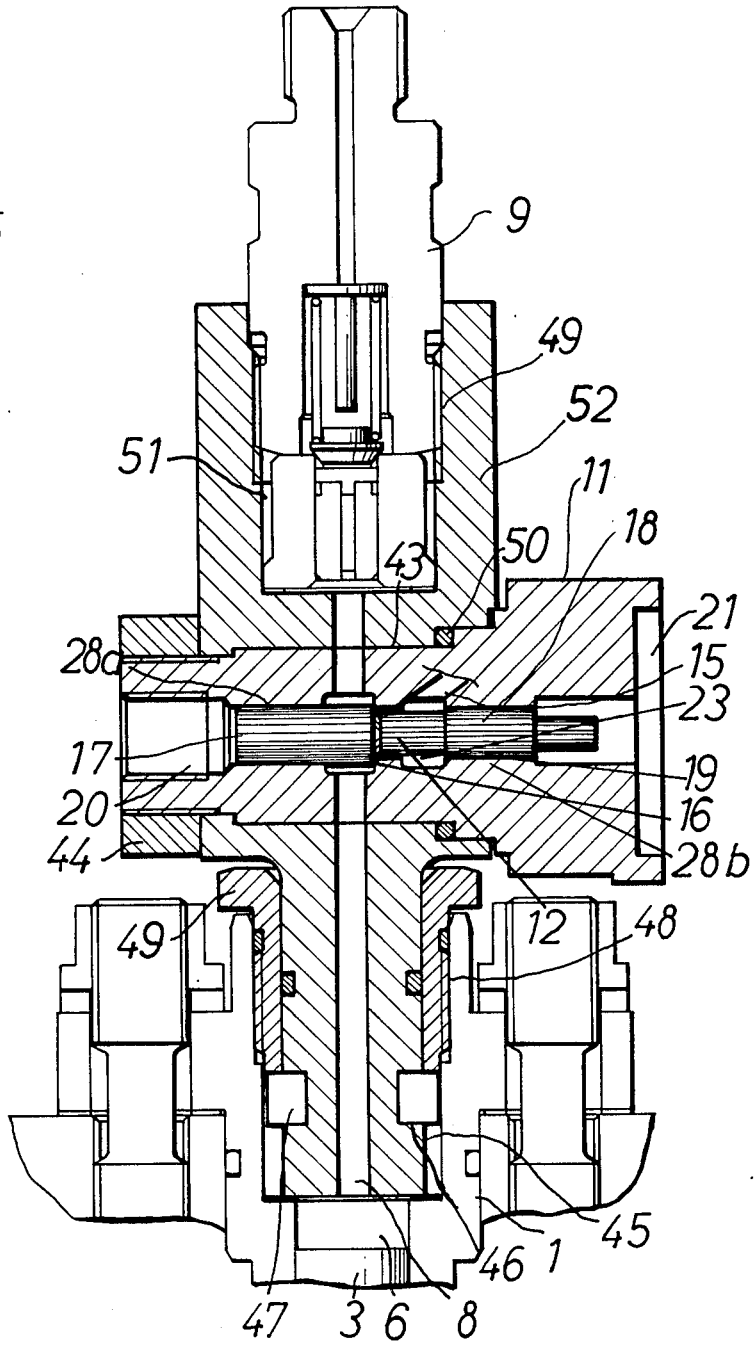
FIG. 5 shows an inventive fuel injection arrangement whereby the control valve is provided in a holding element which is adapted to the fuel injection pump.

In the embodiment of the inventive fuel injection arrangement shown in FIG. 5, only those elements necessary for the understanding of this embodiment are illustrated. The control valve 11 is provided in a special holding device 52, as a result of which it is possible to retrofit or subsequently install the inventively embodied control valve into fuel injection pump elements which are in common use today without any special reworking of the pump. Essential for mounting the inventive control valve 11 in the holding device 52 is that the holding force exerted upon the control valve 11 be exerted in the longitudinal direction of the piston valve 12 in order to reliably avoid possible deformations or stresses of the sealing gaps 28*a* and 28*b* on the high-pressure and low-pressure ends. The holding device 52 is provided with a stepped bore 43 in which is placed the control valve 11 along with a sealing element 50. One end face of the control valve, which projects beyond the holding device 52, is provided with a thread onto which a nut 44 can be threaded, so that the control valve 11 is connected with the holding device 52 in a pressure-tight manner by means of a holding force which is directed in the longitudinal direction of the piston valve 12. On the pump side, the holding device 52 is provided with a connecting piece 45 which can be inserted in a connection bore 48 of the fuel injection pump 1. This bore 48 has the customary dimensions for receiving the pressure valve 9, so that mounting the control valve 11 via the holding element 52 can be effected without having to rework the pump. To mount the holding element 52, the connecting piece 45 is provided with a recessed portion 46 in which two annular pressure elements 47 preferably are disposed. A fastening member 49 is threaded onto the threads of the connection bore 48. This fastening member 49 is in operative connection with the pressure elements 47 and connects the holding element 52 in a pressure-tight manner with the fuel injection pump 1, and hence with the pump chamber 6, via these elements 47. On the side remote from the fuel injection pump there is provided a receiving space 51 for the pressure valve 9; the space 51 is embodied in a manner similar to the receiving bore 48 of the fuel injection pump 1. It should be noted that the bore 43 of the holding element 52 is slightly oversized in order to avoid possible deformations or stresses of the sealing gaps 28*a* and 28*b* on the low and high pressure sides, which deformations could be caused during mounting of the pressure valve 9 in the receiving space 51.

The present invention is, of course, in no way restricted to the specific disclosure of the specification and drawings, but also encompasses any modifications within the scope of the appended claims.

What we claim is:

1. A fuel injection arrangement for an air-compressing, spontaneous ignition, internal combustion engine; said arrangement includes at least one electromagnetic control valve, via which a high-pressure channel associated with a fuel injection pump, which is provided with an intake line, can be connected with a low-pressure channel; said control valve includes a valve body which is in the form of a piston valve and is spring-loaded; said piston valve has a high-pressure end and a low-pressure end, and two end faces; said piston valve is axially movable in a first chamber which includes at least one high-pressure connection associated with said high-pressure channel and said high-pressure end of said piston valve, and at least one low-pressure connection associated with said low-pressure channel and said low-pressure end of said piston valve; said piston valve is in operative connection with an electromagnetic adjusting device;

the improvement comprises the provisioning of said piston valve with a valve seat for delimiting that piston valve region on said high-pressure end of said piston valve; said last-mentioned region has a fixed diameter which corresponds to the diameter of said valve seat, and that piston valve region on said low-pressure end of said piston valve has a diameter which is less than said fixed diameter;

said first chamber including a second chamber, which is associated with said high-pressure end of said piston valve and one of said end faces thereof, and a third chamber, which is associated with said low-pressure end of said piston valve and the other one of said end faces thereof;

at least one line for connecting said high-pressure second chamber and said low-pressure third chamber;

that piston valve region on said low-pressure end of said piston valve being provided with a fourth chamber which begins at said valve seat, and cooperates with said low-pressure connection of said first chamber.

2. A fuel injection arrangement according to claim 1, in which said spring-loading of said piston valve, and the connection of the latter to said adjusting device, are such that that end face region of said piston valve which is subjected to pressure from said high-pressure second chamber is greater than that end face region of said piston valve which is subjected to pressure from said low-pressure third chamber.

3. A fuel injection arrangement for an air-compressing, spontaneous ignition, internal combustion engine; said arrangement includes at least one electromagnetic control valve, via which a high-pressure channel associated with a fuel injection pump, which is provided with an intake line, can be connected with a low-pressure channel; said control valve includes a valve body which is in the form of a piston valve and is spring-loaded; said piston valve has a high-pressure end and a low-pressure end, and two end faces; said piston valve is axially movable in a first chamber which includes at least one high-pressure connection associated with said high-pressure channel and said high-pressure end of said piston valve, and at least one low-pressure connection associated with said low-pressure channel and said low-pressure end of said piston valve; said piston valve is in operative connection with an electromagnetic adjusting device;

the improvement comprises the provisioning of said piston valve with a valve seat for delimiting that piston valve region on said high-pressure end of said piston valve; said last-mentioned region has a fixed diameter which corresponds to the diameter of said valve seat, and that piston valve region on said low-pressure end of said piston valve has a diameter which is less than said fixed diameter;

said first chamber including a second chamber, which is associated with said high-pressure end of said piston valve and one of said end faces thereof, and a third chamber, which is associated with said low-pressure end of said piston valve and the other one of said end faces thereof;

at least one line for connecting said high-pressure second chamber and said low-pressure third chamber;

said spring-loading of said piston valve being effected by a spring which is provided at that end face of said piston valve at said high-pressure end thereof, and which acts upon said piston valve for closing same.

4. A fuel injection arrangement according to claim 3, in which said electromagnetic adjusting device is provided at that end face of said piston valve at said low-pressure end thereof, and acts upon said piston valve for opening same.

5. A fuel injection arrangement according to claim 4, in which said adjusting device is designed in such a way that it can actuate said piston valve for opening same after a prestroke travel of said adjusting device.

6. A fuel injection arrangement according to claim 5, in which said adjusting device comprises a first switching coil and a second switching coil, each of which includes an iron core and an armature.

7. A fuel injection arrangement according to claim 6, in which said piston valve is adapted to be actuated in the opening direction by said first switching coil.

8. A fuel injection arrangement according to claim 7, in which said piston valve is adapted to be held in the open position by means of said first switching coil.

9. A fuel injection arrangement according to claim 6, which includes a spring element which is attached to said armature of said first switching coil, and which can be prestressed by energization of said first switching coil.

10. A fuel injection arrangement according to claim 9, which includes a spacer provided on said armature of said first switching coil for delimiting the prestress travel of said spring element.

11. A fuel injection arrangement according to claim 6, in which during operation of said adjusting device, said first switching coil is adapted to be deenergized for actuating said piston valve in the opening direction.

12. A fuel injection arrangement according to claim 10, in which said armature of said second switching coil comprises two pieces, namely an inner armature part, and an outer armature part; said inner armature part is axially movable relative to said outer armature part.

13. A fuel injection arrangement according to claim 12, in which said inner and outer armature parts of said second switching coil can be coupled together for an axial movement.

14. A fuel injection arrangement according to claim 12, in which said piston valve is adapted to be actuated in the closing direction by deenergization of said second switching coil.

15. A fuel injection arrangement according to claim 12, in which said first and second switching coils, along with their associated armatures and iron cores, are associated with said low-pressure end of said piston valve; said inner armature part of said second switching coil is in direct operative connection with said piston valve, and said armature of said first switching coil is in direct operative connection with said inner armature part.

16. A fuel injection arrangement according to claim 15, which includes a stop element disposed between said armature of said first coil and said outer armature part for delimiting the axial stroke movement of the latter.

17. A fuel injection arrangement according to claim 16, in which said stop element, and said spacer of said armature of said first switching coil, are designed in such a way that at maximum prestress of said spring element, a pre-stroke space exists, in the closure position of said piston valve, between said inner armature part of said second switching coil, and said armature of said first switching coil.

18. A fuel injection arrangement according to claim 16, which includes a further spacer which is provided between said outer armature part and said iron core of said second switching coil for delimiting the axial movement of said outer armature part.

19. A fuel injection arrangement according to claim 18, in which a stop element is associated with that end face of said piston valve on said high-pressure end thereof.

20. A fuel injection arrangement according to claim 12, in which said fuel injection pump includes a pump element which can be rotated about an axis which extends in the longitudinal direction of said pump element; the latter is provided with a longitudinal groove.

21. A fuel injection arrangement according to claim 20, in which said longitudinal groove is provided in the surface of said pump element, and can be connected with a pump chamber.

22. A fuel injection arrangement according to claim 20, in which, for rotation thereof, said pump element can be actuated by a mechanical regulating device which is influenced by the speed of said internal combustion engine; said longitudinal groove can be made to overlap said intake line.

23. A fuel injection arrangement according to claim 20, in which a sensor is provided in the movement region of one of said armatures and said end faces of said piston valve; said sensor comprises a permanent magnet, pole pieces, and an induction coil, and, as a function of one of movement of said piston valve and an air gap at one of said end faces of said piston valve, generates a pulse-like signal of said control valve for beginning of closure and/or opening of said valve.

24. A fuel injection arrangement according to claim 12, which includes a holding element which can be connected to said fuel injection pump; said control valve is associated with said holding element, and can be held on said piston valve by means of a holding force applied in the longitudinal direction of the latter.

* * * * *